United States Patent [19]

Braun, Jr. et al.

[11] 3,972,291

[45] Aug. 3, 1976

[54] EXTENDED RANGE TRACER FOLDED CUP

[75] Inventors: Frank E. Braun, Jr., Chalfont, Pa.; Wilmer White, Haddonfield, N.J.

[73] Assignee: The United States of America as represented by the Secretary of the Army, Washington, D.C.

[22] Filed: Nov. 22, 1974

[21] Appl. No.: 526,193

[52] U.S. Cl. ..... 102/87; 102/60; 149/43; 149/61

[51] Int. Cl.[2] ..... F42B 11/16

[58] Field of Search ..... 102/6, 60, 66, 87, 90, 102/49.3; 149/43, 44, 61; 60/253

[56] References Cited

UNITED STATES PATENTS

| | | | |
|---|---|---|---|
| 2,814,179 | 11/1957 | Edelman et al. | 60/253 |
| 3,013,495 | 12/1961 | Stevenson et al. | 102/87 X |
| 3,135,201 | 6/1964 | Hansson et al. | 102/87 X |
| 3,494,285 | 2/1970 | Doris, Jr. et al. | 102/87 |
| 3,515,072 | 6/1970 | Barr | 102/87 |
| 3,633,512 | 1/1972 | Schlack | 102/87 |
| 3,710,723 | 1/1973 | Muller et al. | 102/87 |
| 3,765,336 | 10/1973 | Kulsik | 102/87 |
| 3,886,009 | 5/1975 | Puchalski | 149/61 |

*Primary Examiner*—Harold Tudor
*Attorney, Agent, or Firm*—Nathan Edelberg; Robert P. Gibson; Kalman Pollen

[57] ABSTRACT

Tracer projectile having an enlarged diameter cavity wherein pyrotechnic tracer mixture therein is caused to end-burn sequentially in opposed directions by means of a folded cup-shaped device to thereby extend the duration of visibility and improve the quality of downrange visibility of the tracer and yet permit ballistics of the projectile to remain unaffected.

6 Claims, 3 Drawing Figures

PRIOR ART

EXTENDED RANGE TRACER FOLDED CUP

The invention described herein may be manufactured, used and licensed by or for the Government for governmental purposes without the payment to us of any royalty thereon.

This invention relates to tracer ammunition and more particularly concerns means for extending the duration of visibility of tracer ammunition.

One of the most important means for directing the fire of modern rapidfire weapons is through the use of tracers. Although modern weapons are fitted with precision sights and some even with telescopes for pinpointing targets, these weapons are still most effective at close range and against slow moving or stationary targets. The prior art tracer projectiles typically consisted of a projectile having a single cavity at the base thereof wherein the consolidated pyrotechnic tracer mixture was contained. The visible range, or trace, along the projectile's trajectory has been largely dependent upon the chemical composition of the pyrotechnic mixture as well as the available length (or depth) of the tracer cavity. A compressed column of pyrotechnic mixture upon ignition at one end, burns in cigarette fashion toward the opposite end. Today, as more sophisticated and longer range ammunition are being developed, there is a growing requirement for tracer projectiles having longer visible ranges.

It is therefore a principal object of this invention to extend the effective range of tracers without significantly modifying the exterior ballistics of the tracer projectile.

This and further objects of the invention will be readily apparent from the following description and accompanying drawings wherein.

Figure 1:
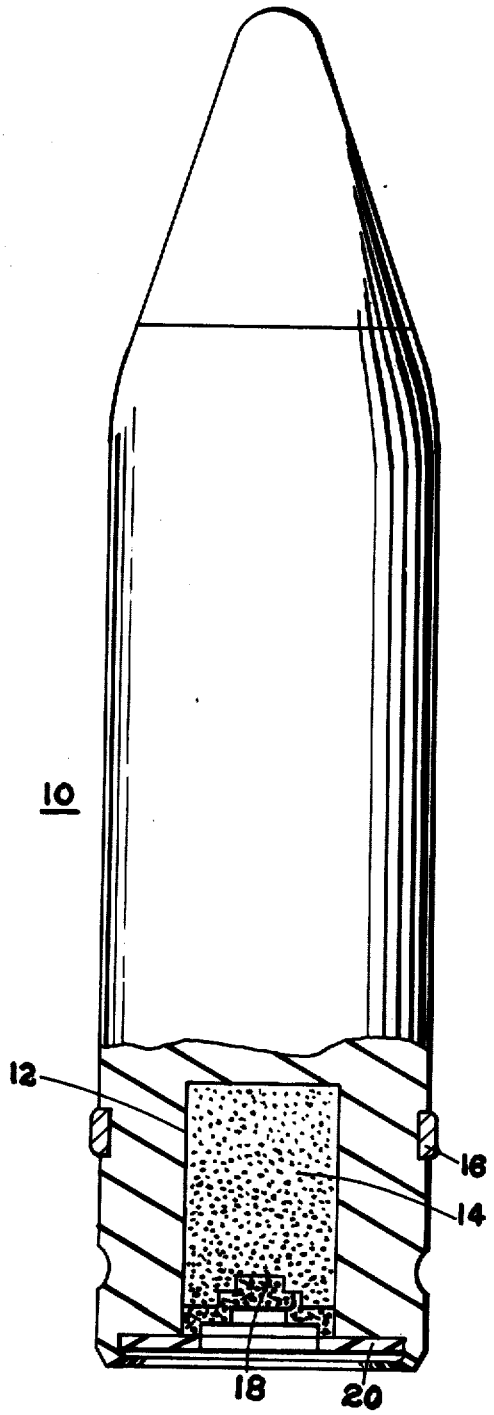
FIG. 1 is a partially sectioned view of a prior art projectile containing a conventional tracer cavity therein.

Referring now to FIG. 1 of the drawings there is shown at 10 a conventional tracer projectile having a tracer cavity 12, pyrotechnic tracer mixture 14, rotating band 16, igniter mixture 18, and metering disc 20, all as known in the prior art.

Figure 2:
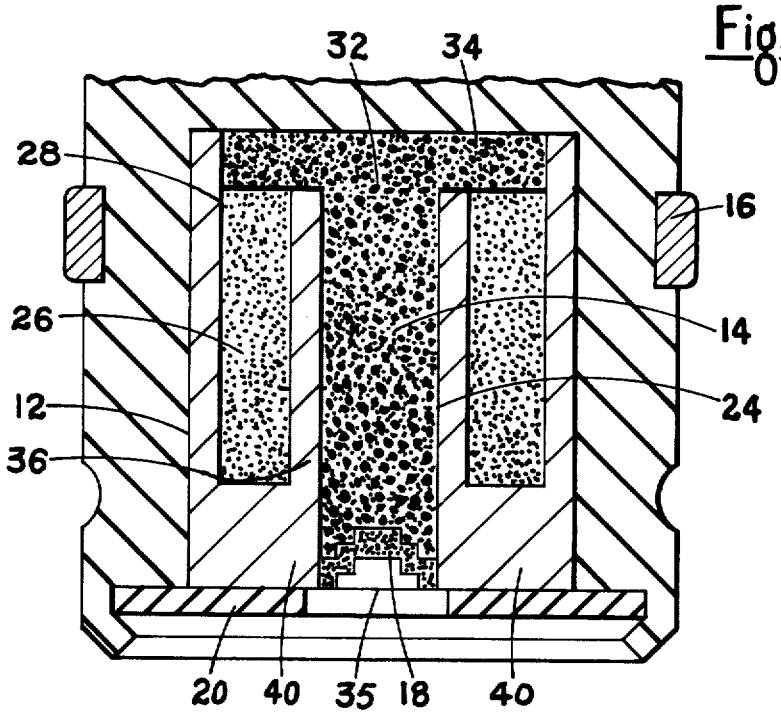
FIG. 2 is a sectional view of a portion of a tracer projectile containing a tracer cavity of enlarged diameter which receives our folded cupshaped device.
Figure 3:
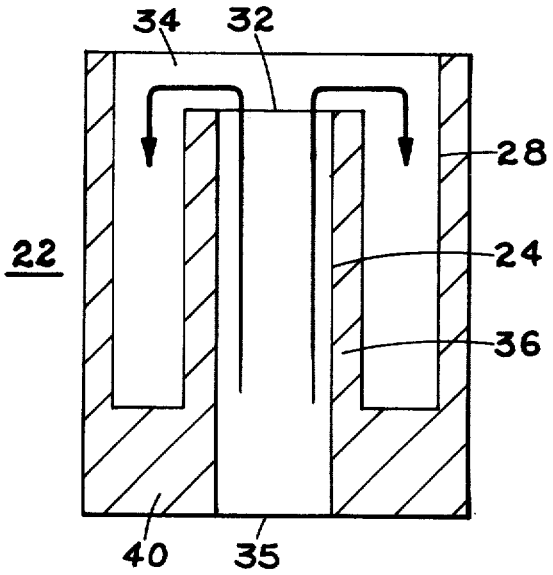
FIG. 3 illustrates a section of our cup-shaped device shown in FIG. 2.

Tracer cavity 12 is enlarged as shown in FIG. 2 to receive a folded cup 22 which is shown secured within the cavity by metering disc 20, the cup containing pyrotechnic tracer mixture 14 in central cavity 24 thereof and further containing downrange pyrotechnic tracer mixture 26 in annular cavity 28, the cup causing ignition to proceed in central cavity 24 from a conventional igniter mixture 18 through orifice 32 of the folded cup towards its forward end 34 as indicated by arrows in FIG. 3, forward end 34 being integral and coextensive with annular cavity 28 and central cavity 24, and thence rearwardly as the downrange pyrotechnic tracer mixture is caused to ignite, the flame exiting through rear 35 of central cavity 24. In our folded cup the annular cavity incloses a greater volume than the central cavity. As the burning front transfers from central cavity 24 to annular cavity 28, an increased quantity of pyrotechnic mixture is caused to be burned to thus increase the pressures within folded cup 22 to effect an accelerated burning rate of downrange pyrotechnic tracer mixture 26. Thus, it is apparent that the downrange pyrotechnic tracer mixture burns more rapidly than the pyrotechnic tracer mixture within the central cavity thereby yielding a more intense flame. As the downrange pyrotechnic tracer mixture in the annular cavity is burning under increased pressure, inner wall 36, preferably aluminum, will melt away to thus add fuel to the pyrotechnic racer mixtures.

Conventional tracers burn with a comparatively constant light output throughout the duration of flight. Our tracers emit a somewhat dimmer light output in its initial stages of burning in central cavity 24 (less pyrotechnic mixture is present thereat than in the single cavity of conventional tracers). Consequently the gunner's position is more difficult to pinpoint.

The composition of folded cup 22 should be a light metal having a melting point between about 600°–700°C, preferably Al as abovementioned although magnesium is also suitable as are alloys of these two metals, so long as their melting points range between about 600°–700°C. Metals or alloys having higher melting points than about 700°C tend to cause folded cup 22 to burst as the aforementioned burning front fans out in orifice 32 since such higher melting point metals frequently fail to melt at the portion of inner wall 36 adjacent orifice 32 under increased pressures. Metals having lower melting points than about 600°C tend to be subject to burnthrough at inner wall 36 to cause premature burning of pyrotechnic tracer mixture 14 in annular cavity 28. For 20mm ammunition, inner wall 36 should have a thickness of about 0.035–0.045 inch, below the lower limits of which a tendency for burnthrough occurs. The quantity of pyrotechnic tracer mixture is diminished with no concomitant advantage when the wall thickness exceeds about 0.045 inch. Rearward wall 40 should preferably have a minimum thickness of at least 0.125 inch in order to withstand gas pressures thereat.

Firing tests were conducted to compare the performance of 20mm tracer projectiles containing the folded cup with tracers having the standard tracer cavity. The results of these tests in Table I below indicate that tracers having our folded cup achieve a 46–58% increase in length of trace beyond that attained by the conventional prior art tracer projectiles. Average duration of trace is also substantially increased using our folded cup. Table II lists the specific ingredients of our various downrange pyrotechnic tracer mixtures and weight percentages thereof.

TABLE I

Burning Time & Trace Range Data

| Mixture in annular cavity | Mixture in annular cavity, weight(gms) | No. 1 Pyrotechnic tracer mixture in central cavity, weight(gms) | Avg. time of trace (seconds) | Avg. length of trace (meters) |
|---|---|---|---|---|
| No. 1 | 1.54 | .79 | 6.8 | 2640 |
| No. 2 | 1.46 | .65 | 6.5 | 2630 |
| No. 3 | 1.53 | .70 | 7.4 | 2840 |
| No. 4 | 1.58 | .79 | 7.1 | 2730 |
| No. 5 | 1.38 | .68 | 7.5 | 2845 |
| No. 6 | 1.37 | .67 | 7.5 | 2830 |
| No. 7 | 1.39 | .66 | 7.4 | 2830 |
| Inert** | 1.55 | .65 | 5.0 | 2250 |
| — | — | 3.00* | 3.1 | 1800 |

*M246 standard prior art tracer projectile filled with No. 1 tracer mixture.
**Inert: Calcium Carbonate

TABLE II

| Ingredients | Tracer Mixtures, wt.% No. 1 | No. 2 | No. 3 | No. 4 | No. 5 | No. 6 | No. 7 | Function |
|---|---|---|---|---|---|---|---|---|
| Mg | 28.0 | 46.0 | 22.4 | 23.4 | 25.0 | 25.0 | 30.0 | Fuel |
| $Sr(NO_3)_2$ | 55.0 | 20.0 | 32.0 | 33.5 | 45.0 | 40.0 | 40.0 | Oxidizer |
| $KClO_4$ | | 10.0 | 16.0 | 16.7 | | | | Oxidizer |
| $NaNO_3$ | | 15.0 | | | | | | Oxidizer |
| $MnO_2$ | | | | 4.0 | | | | Oxidizer/Cat. |
| Calcium Resinate | | 2.0 | 3.2 | 3.3 | 5.0 | 5.0 | 10.0 | Fuel/Binder |
| Polyvinyl Chloride | 17.0 | | | | 25.0 | 30.0 | 20.0 | Fuel/Binder Color Intensifier |
| Polyethylene Powder | | 0.5 | | | | | | Binder |
| $SrC_2O_4$ | | 4.0 | 6.4 | 6.7 | | | | Burning Rate Mod. Color Intensifier |
| Dechlorane | | 2.5 | 5.0 | 2.8 | | | | Burning Rate Mod. Color Intensifier |
| Oxamide | | | 15.0 | 9.6 | | | | Burning Rate Mod. |

The length of trace was determined using Doppler radar. To determine the time of trace, an accelerometer was mounted on the weapon firing the tracer, the accelerometer starting a chronograph upon the firing of a round. When tracer burnout was observed, the chronograph was stopped by means of a switch.

In those 20mm tracer projectiles in which our folded cup was used, the diameter of the conventional or prior art tracer cavity was enlarged from 0.375 to 0.500 inch to accommodate the folded cup. Various pyrotechnic tracer mixtures noted in the above tables were then charged by conventional loading methods into the annular cavity of the folded cup. Mixture No. 1 was next charged by conventional loading methods into the central cavity of all folded cups tested and into the single cavity of conventional M246 tracers employed. Variations in loading techniques caused weight differences of the pyrotechnic tracer mixture in the central cavity of the folded cup (Table I). However, all projectiles employing our folded cups succeeded in achieving a substantial increase in length of trace over the prior art. Igniter mixture 18 is conventional, and may comprise by weight, 14.1% magnesium, 78.3% barium peroxide, 1.0% toluidine red, 1% zinc sterate, and 5.6% parlon, a chlorinated rubber compound of Hercules Company. All mixtures in Table II contain the fuel magnesium metal and the oxidizer strontium nitrate. Downrange pytechnic tracer mixture No. 5 provided the longest length of trace and was observed to have adequate downrange brightness.

The downrange pyrotechnic tracer mixture in the annular cavity of the folded cup should preferably be a comparatively slow burning pyrotechnic mixture such as designated by No. 5. Such mixtures under identical burning conditions burn more slowly than the pyrotechnic tracer mixture charged into the central cavity of the folded cup and so avoid undesirably rapid ignition of the downrange pyrotechnic tracer mixtures.

From Table I it is apparent that the inert mixture provided an approximately 25% increase in length of trace over conventional tracers. This increase is attributable to the fact that tracer columns of larger diameter tend to burn more rapidly than columns of lesser diameter, the single cavity of the conventional tracer being of greater diameter than the central cavity of the folded cup.

Our novel folded cup may be used with all small arms tracer ammunition. Through the use of the folded cup the visible range of small arms tracer ammunition has been considerably extended without affecting exterior ballistics of the projectile. Through the practice of our invention greater and more effective small arms firepower may be directed onto the target.

We claim:

1. In a tracer projectile having a tracer cavity extending into the rear end of the projectile, a metal folded cup mating within said cavity and secured therein by a disc, said folded cup comprising a rearward wall, an inner wall and an outer wall concentric with said inner wall, said rearward wall of said folded cup being adjacent the rear end of the projectile, said inner wall and said outer concentric wall extending forwardly axially from said rearward wall and defining an annular cavity between said inner and said outer wall, said inner wall being slightly shorter in length than said outer wall, said inner wall defining a central cavity which extends through said rearward wall, said annular cavity inclosing a greater volume than said central cavity, said folded cup having a forward end integral with said annular cavity and said central cavity, said annular cavity and said central cavity being coextensive with a rearward portion of said forward end and in abutting relation therewith; said folded cup containing pyrotechnic tracer formulation and causing a burning front thereof to proceed forwardly in said central cavity from adjacent said rearward wall whereby said burning front is caused to reverse its direction at said forward end and to proceed rearwardly in said annular cavity to provide a more intense flame and increased pressures therein, said inner wall melting during burning of said pyrotechnic tracer formulation in said annular cavity.

2. The folded cup according to claim 1 wherein said metal is selected from the group consisting of aluminum, magnesium and alloys thereof melting between about 600°–700°C.

3. The folded cup according to claim 1 wherein said metal is aluminum.

4. The folded cup according to claim 1 wherein said pyrotechnic formulation comprises two pyrotechnic tracer mixtures, one of said two pyrotechnic tracer mixtures disposed in said central cavity and said forward end and the other pyrotechnic tracer mixture being a downrange pyrotechnic tracer mixture disposed in said annular cavity, said downrange pyrotechnic tracer mixture burning more rapidly than said pyrotechnic tracer mixture disposed in said central cavity and said forward end.

5. The folded cup according to claim 1 wherein said projectile containing said folded cup is 20mm is size and said inner concentric wall of said folded cup is about 0.035–0.045 inch in thickness.

6. In a tracer projectile having a tracer cavity extending into the rear end of the projectile, a metal folded cup mating within said cavity and secured therein by a disc, said folded cup comprising a rearward wall, an inner wall and an outer wall concentric with said inner wall, said rearward wall of said folded cup being adjacent the rear end of the projectile said inner wall and said outer concentric wall extending forwardly axially from said rearward wall and defining an annular cavity between said inner and said outer wall, said inner wall being slightly shorter in length than said outer wall, said inner wall defining a central cavity which extends through said rearward wall, said annular cavity inclosing a greater volume than said central cavity, said folded cup having a forward end integral with said annular cavity and said central cavity, said annular cavity and said central cavity being coextensive with a rearward portion of said forward end and in abutting relation therewith; said folded cup containing pyrotechnic tracer formulation, said pyrotechnic tracer formulation comprising two pyrotechnic tracer mixtures, one of said two pyrotechnic tracer mixtures disposed in said central cavity and said forward end of said folded cup, and the other pyrotechnic tracer mixture being a downrange pyrotechnic tracer mixture disposed in said annular cavity, said downrange pyrotechnic mixture burning more rapidly than said pyrotechnic tracer mixture disposed in said central cavity and said forward end of said folded cup, said pyrotechnic tracer mixture in said central cavity and said forward end of said folded cup comprising by weight about 28.0% magnesium, about 55.0% strontium nitrate, and about 17.0% polyvinyl chloride, and said downrange pyrotechnic mixture comprising by weight about 25.0% magnesium, about 45.0% strontium nitrate, about 5.0% calcium resinate, and about 25.0% polyvinyl chloride; said folded cup containing said pyrotechnic tracer formulation causing a burning front thereof to proceed forwardly in said central cavity from adjacent said rearward wall whereby said burning front is caused to reverse its direction at said forward end and to proceed rearwardly in said annular cavity to provide a more intense flame and increased pressures therein, said inner wall melting during burning of said pyrotechnic tracer formulation in said annular cavity.

* * * * *